US005222335A

United States Patent [19]

Petrecca

[11] Patent Number: 5,222,335

[45] Date of Patent: Jun. 29, 1993

[54] METAL TRACK SYSTEM FOR METAL STUDS

[76] Inventor: Anthony Petrecca, 142 Washington Ave., Fort Lee, N.J. 07024

[21] Appl. No.: 904,855

[22] Filed: Jun. 26, 1992

[51] Int. Cl.[5] ..... E04B 2/58

[52] U.S. Cl. ..... 52/105; 52/241; 52/656.9; 52/735; 52/731.5; 52/348; 403/230

[58] Field of Search ..... 52/241, 243, 721, 735, 52/292, 731.5, 656.9, 290, 481, 350, 105, 792, 348, 690; 403/230, 245

[56] References Cited

U.S. PATENT DOCUMENTS

| | | | |
|---|---|---|---|
| D. 203,133 | 12/1965 | Senek et al. | 52/241 X |
| 2,235,761 | 3/1941 | Goldsmith | 52/292 |
| 2,275,109 | 3/1942 | McGee | 52/241 |
| 2,410,922 | 11/1946 | Balduf | 52/481 |
| 3,001,615 | 9/1961 | Ries | 52/241 X |
| 3,217,452 | 11/1965 | Steele | 52/241 |
| 3,536,345 | 10/1970 | Leifer | 52/241 X |
| 3,852,927 | 12/1974 | Birum, Jr. | 52/241 X |
| 4,492,066 | 1/1985 | La Londe | 52/668 |
| 4,739,918 | 4/1988 | Stokes et al. | 228/173.6 |
| 4,805,364 | 2/1989 | Smolik | 52/241 |
| 4,809,476 | 3/1989 | Satchell | 52/241 |
| 4,854,096 | 8/1989 | Smolik | 52/735 X |
| 4,918,899 | 4/1990 | Karytinos | 52/690 |

*Primary Examiner*—Carl D. Friedman
*Assistant Examiner*—Robert J. Canfield
*Attorney, Agent, or Firm*—Eliot S. Gerber

[57] ABSTRACT

Framing for drywall building construction consists of vertical metal U-shaped studs whose ends are positioned with U-shaped metal top and bottom tracks. The tracks have spaced sets of inward protrusions, preferably dimples, formed from the sidewalls of the tracks. The studs are snapped into the sets of protrusions and held therein.

2 Claims, 5 Drawing Sheets

METAL TRACK SYSTEM FOR METAL STUDS

BACKGROUND OF THE INVENTION

Field of the Invention

The present invention relates to building construction systems and more particularly to building construction systems for installing metal studs in metal tracks for the framing in drywall construction.

Description of the Related Art

Both interior and exterior walls in building construction generally consist of vertical studs which are held between a floor joist and a ceiling joist. Generally the studs are of 2×4 or 2×6 wood studs and are covered by plywood, if an exterior wall or gypsum wallboard, if an interior wall.

However, in modern commercial construction the wooden studs and joists, in non-load-bearing walls, are replaced by metal studs and tracks, primarily for fire resistance considerations. The metal studs are covered by drywall, i.e., gypsum wallboard, which holds the metal studs in place, since the wallboard is fastened to the studs and tracks.

The studs and tracks are both U-shaped members formed from sheet metal, for example, galvanized steel. The width of the stud may be typically 3¾ inches and the interior width of the track is also 3¼ inches to accommodate the width of the studs.

The installation of the metal studs into metal tracks has proven to be relatively time-consuming. For example, the installer will measure and mark the location of a metal stud, place a metal stud in a metal track at the marked location, drive a first screw through a stud wall and track wall at the bottom of the stud and drive a second screw through a stud wall and track wall at the top of the stud. Sometimes the studs are not aligned vertically, i.e., they tilt, which may make it difficult to locate them when attaching the wallboard.

The only purpose of the top and bottom screws holding the stud in the top and bottom tracks is to hold them in vertical alignment until the wallboard is fastened to the studs and tracks.

In U.S. Pat. No. 4,787,767 a stud clip holds studs in ceiling and floor rails. The studs are screwed to the stud clips.

In U.S. Pat. No. 4,850,169 and Des. 301,745 studs are snapped into specially shaped holes in the bottom walls of tracks.

SUMMARY OF THE INVENTION

The present invention provides a metal track system which is adapted to receive and hold conventional metal studs in correctly aligned vertical positions.

The tracks are U-shaped and formed of sheet metal. The tracks are only of one shape and size, for each width of stud, so the tracks may be used on the floor and on top of the studs. The tracks have spaced protrusion means to hold the studs. Preferably the protrusion means are four raised dimples or lances. Two dimples or lances are located spaced apart 1¼ inches on each of the opposite walls of the track. The protrusion means are spaced, preferably at 8-inch centers, along the length of the tracks.

To install a stud, the installer simply places a stud within a track next to the protrusion means on the bottom and top tracks and snaps the stud into place. There is no need for screws to hold the stud in place, as the stud is held correctly vertically aligned by the protrusion means in the bottom and top tracks.

BRIEF DESCRIPTION OF THE DRAWINGS

The following detailed description should be taken in conjunction with the accompanying drawings.

In the drawings.

DETAILED DESCRIPTION OF THE INVENTION

Figure 1:
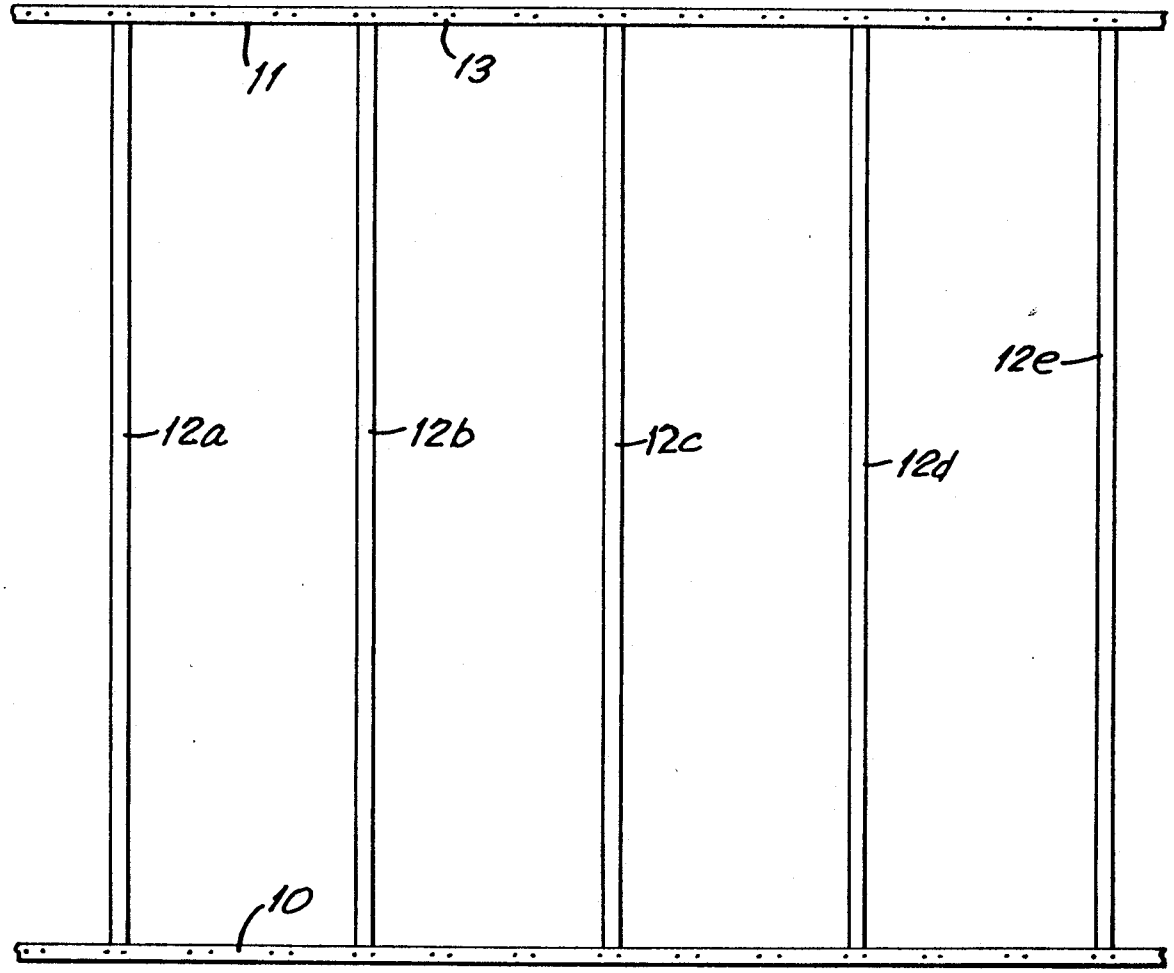
FIG. 1 is a front view of the stud and track system of the present invention.

As shown in FIG. 1, the metal track metal stud system of the present invention includes a horizontal aligned bottom track 10, a horizontal aligned top track 11, and a series of vertical aligned studs 12*a*, 12*b*, 12*c*, etc. Generally the bottom track 10 is fastened to the floor, the top track 11 is secured to ceiling support members, and the studs 12*a*–12*e* are held in the top track 10 and bottom track 11.

Figure 2:
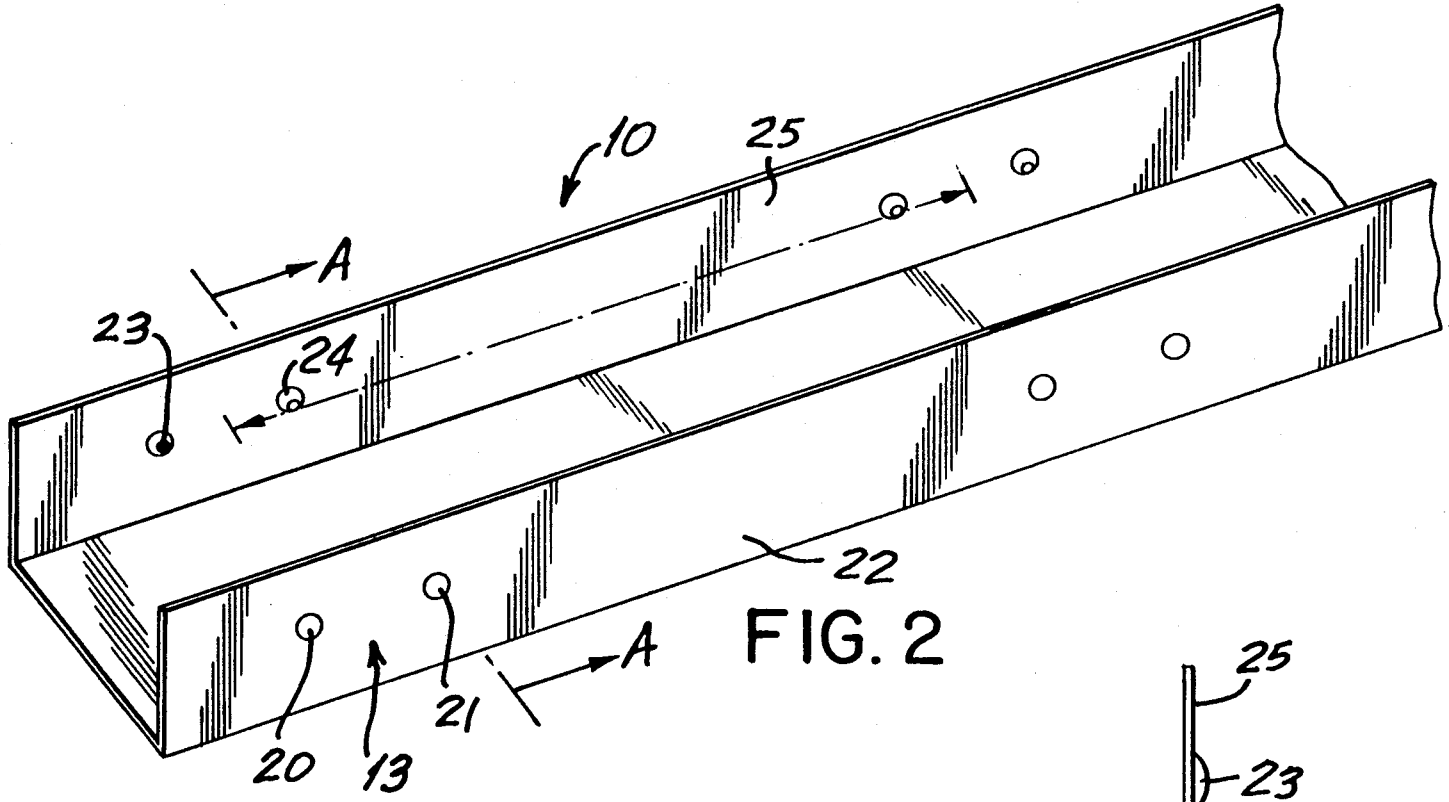
FIG. 2 is a perspective view of the first embodiment of the track of the present invention.
Figure 2A:
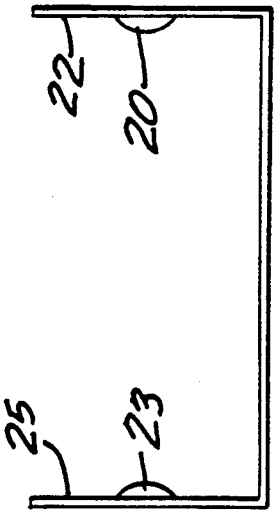
FIG. 2A is an end view of the track of FIG. 2.
Figure 2B:
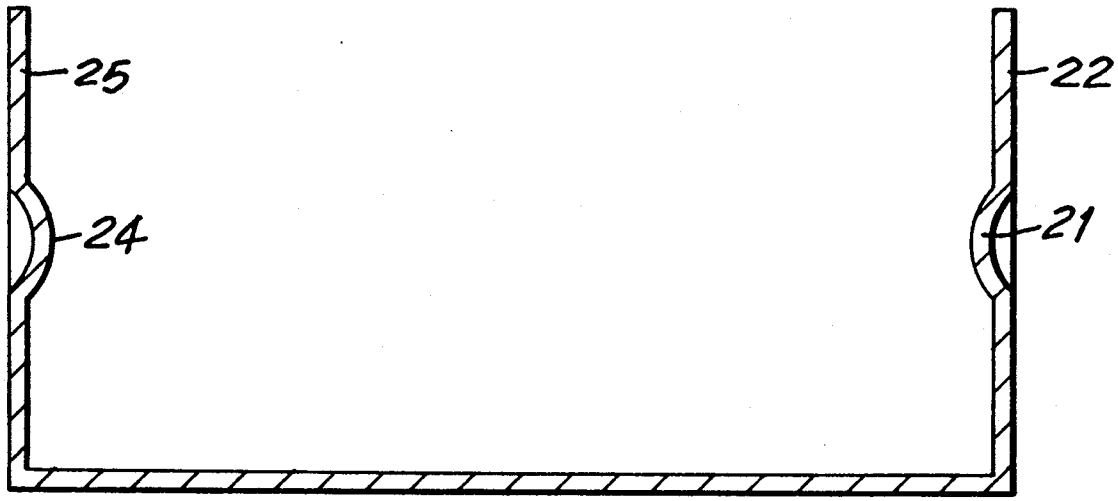
FIG. 2B is an enlarged cross-sectional view of the track of FIG. 2 taken along the line A—A of FIG. 2.

As shown in FIG. 2, the studs are positioned in the tracks by protrusion means 13. In the first embodiment, the protrusion means are indentations inward toward the imaginary center of the U-shaped tracks 10 and 11. Each protrusion means 13 consists of four indentations 20,21 on one arm 22 (sidewall) of track 10 and two indentations 23,24 on the opposite arm 25 (sidewall).

The studs and track are typically formed from hot dipped galvanized rolled steel in 14, 16, 18, 20 and 24 gauge metal.

The studs generally are 8, 10 or 12 feet long and the tracks are 10 or 12 feet long.

The distance from one dimple to another dimple, on a track sidewall, is preferably 1 7/16 inch, taken from the dimple centers, to accommodate a 1¼ inch height of the arms (sidewalls) of the stud. The width of the studs is generally 1⅝, 2, 2½, 3, 3⅝, 4 or 6 inches. The tracks have the same widths, for non-load-bearing walls, as the studs. For example, the width of the stud 12*a* (bottom wall) is 2½ inches, the left arm (sidewall) and right arm (sidewall) are in the range 1.250 to 1.360 inches high and preferably 1.250 (1¼) inch high.

As shown in FIGS. 1, 2, 2A and 2B the indentations 20, 21, 23 and 24 are hemispherical dimples. The preferred size of a dimple, at its base, is 5/16-inch in circumference, measured at the outside of the wall, and its preferred height is about ⅛-inch.

The track's width matches the width of the studs; for example, a 2½ inch wide track would be used with 2½ inch wide stud. The height of the track sidewalls 22,25 is in the range of 1.125-inch to 1.250-inch.

The first and last sets of four indentations are spaced the same distance from the two ends of the track as the width of the studs, for example, 2½ inches for 2½ inch wide studs. Then the indentations are spaced every 8 inches (distance a in FIG. 2) so that the studs may be erected at either 16- or 24-inch spacings measured center-to-center.

Figure 3:
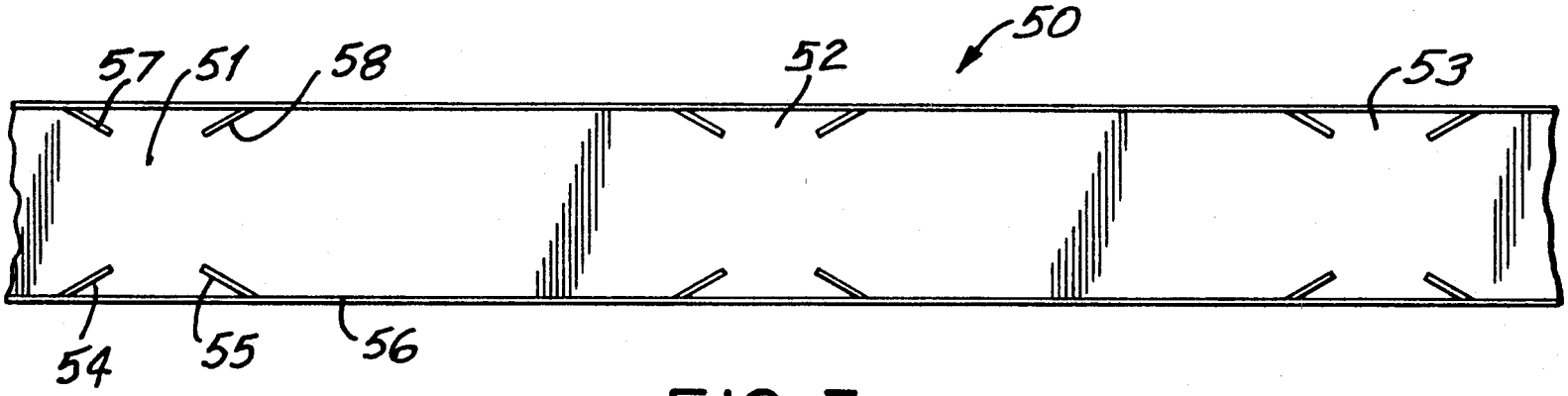
FIG. 3 is a top view of the track of the second embodiment.
Figure 4:
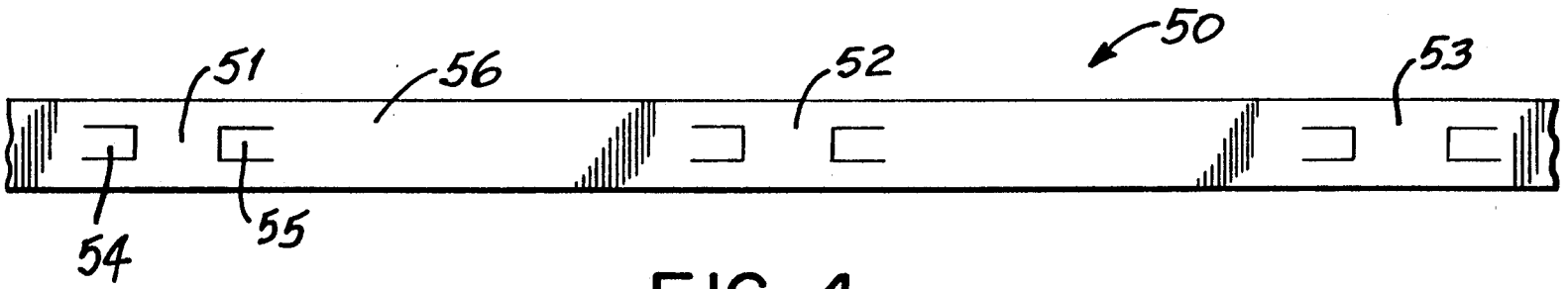
FIG. 4 is a side view of the track of FIG. 3.

In the embodiment shown in FIGS. 3 and 4, the protrusion means consist of inwardly directed sheet metal flaps which are lanced from the sidewalls of the tracks. Track 50 in FIGS. 3 and 4 is shown with three sets of protrusion means 51, 52, 53. Each set consists of two spaced-apart flaps. For example, protrusion means set 51 has flaps 54,55 lanced from sidewall 56 and flaps 57,58 lanced from sidewall 59 all of which flaps are within the track 50. The flaps function in the same manner as the dimples of the prior embodiment to position and hold the studs.

The flaps are shown in FIGS. 3 and 4 as being flat. Alternatively, and shown in FIGS. 5 and 6, they may be L-shaped, with the bottoms of the L shapes facing each other. Flaps 61 and 62 are L-shaped and lanced from the sidewalls 63 and 64, respectively, of track 60.

Figure 5:
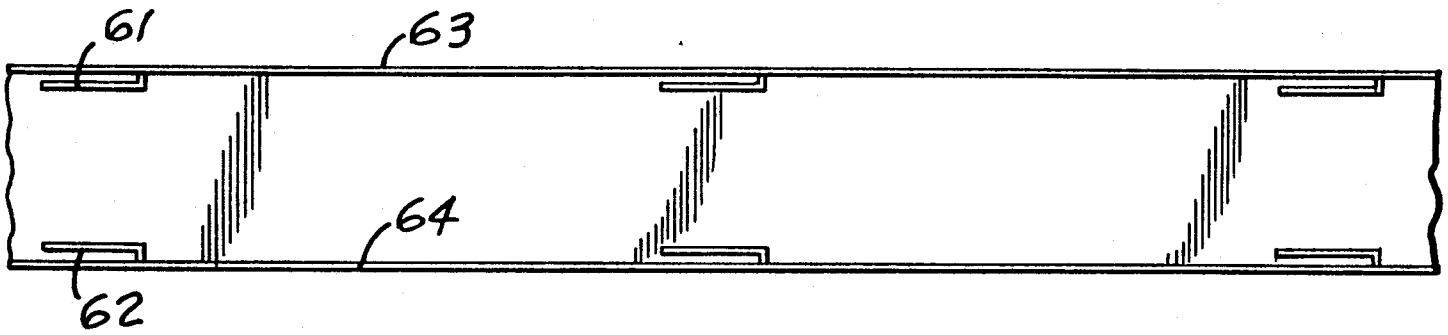
FIG. 5 is a top view of the track of the third embodiment.
Figure 6:
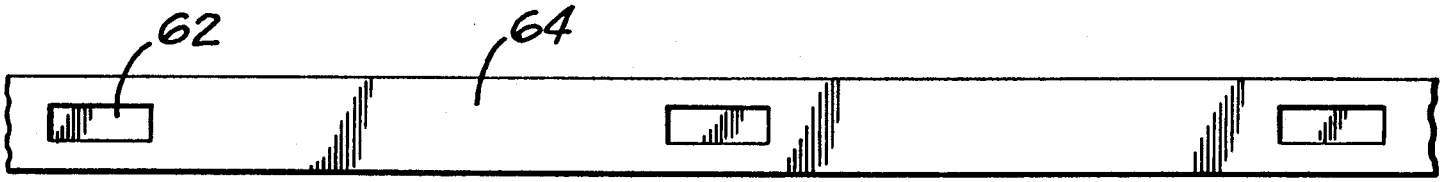
FIG. 6 is a side view of the track of FIG. 5.

The embodiments shown in the drawings FIGS. 1–4 use protrusion means which grip the studs by friction and by the spring-like function of the studs. However, the protrusion means may be used on only one side of the studs as a guidance means, without gripping the studs, as shown in FIGS. 5 and 6. For example, in FIG. 3 such a guidance means would be only the flaps 57 and 54 in set 51, without flaps 58 and 55.

The tracks may have printed vertical lines on the exterior of their sidewalls to indicate the centers of the 8-inch spacings of the protrusion means as a guide for the installer. The dimples may be at one height on one sidewall and a different height on the opposite sidewall.

Other modifications may be made in the present invention within the scope of the claims.

I claim:

1. A track and stud framing system for drywall construction including:

an upper track and spaced therefrom a bottom track, the upper track being horizontally aligned with the bottom track, a plurality of studs positioned within the tracks and vertically aligned, each stud having a bottom end within the bottom track and a top end within the upper track, the tracks and studs being U-shaped elongated channel members formed of sheet metal and each having a bottom wall and two opposite sidewalls;

characterized in that the upper and bottom track sidewalls are parallel and not convergent toward each other, the thickness of the track sheet metal sidewalls are equal to or greater in thickness than the thickness of the sheet metal of the studs; each track has a series of protruding dimples formed from the metal of the sidewall of the track, the dimples are complete hemispherical shaped protrusions without cut-outs therein, the dimples are directed inward toward the imaginary center of the tracks and are used to position the studs, the dimples are arranged in pairs on each track sidewall, with the dimples of each pair on each sidewall being aligned with the dimples of another pair on the opposite sidewall, the spacing between the dimple of each pair is about the same as the width of the stud sidewall, and the dimple pairs are spaced along the track sidewall with the distance between the imaginary center of each pair of dimples being 8 inches.

2. A system as in claim 1 wherein the dimples of each pair are spaced $1\frac{1}{4}$ inch apart.

* * * * *